US005913470A

United States Patent [19]

Scribner

[11] Patent Number: 5,913,470

[45] Date of Patent: Jun. 22, 1999

[54] ROLL FEEDER

[76] Inventor: Albert Willis Scribner, 6 Country Club Rd., Darien, Conn. 06820

[21] Appl. No.: 08/782,800

[22] Filed: Jan. 13, 1997

[51] Int. Cl.[6] ..... G03B 1/56; B65H 20/00; B21B 31/16; F16H 7/00

[52] U.S. Cl. ..... 226/90; 72/246; 226/185; 226/187; 226/188; 226/194; 474/87

[58] Field of Search ..... 226/187, 185, 226/188, 194, 90; 474/87; 72/163, 246, 242.2

[56] References Cited

U.S. PATENT DOCUMENTS

| | | | |
|---|---|---|---|
| 1,614,423 | 1/1927 | Coe | 242/194 X |
| 1,787,558 | 1/1931 | Tinsman | 226/194 X |
| 2,643,475 | 6/1953 | Klopfenstein | 226/187 X |
| 3,077,293 | 2/1963 | Watkins . | |
| 3,263,284 | 8/1966 | Orr et al. | 226/187 X |
| 3,349,981 | 10/1967 | Hawkins et al. . | |
| 3,354,502 | 11/1967 | Powell . | |
| 3,647,127 | 3/1972 | Wiig . | |
| 4,078,416 | 3/1978 | Voorhees et al. . | |
| 4,202,719 | 5/1980 | Linn | 226/188 X |
| 4,284,222 | 8/1981 | Hank . | |
| 4,415,108 | 11/1983 | Katoh . | |
| 4,551,878 | 11/1985 | Turley et al. | 72/163 X |
| 5,406,817 | 4/1995 | Takakura et al. . | |
| 5,457,979 | 10/1995 | Castellani | 72/246 X |

*Primary Examiner*—Michael Mansen

*Attorney, Agent, or Firm*—Albert W. Scribner

[57] ABSTRACT

An electric motor driven roll feed system for intermittently advancing stock into the work station of a punch press. The roll feed system is designed so that its main rotating elements have greatly reduced rotational inertia. A low inertia overall roll arrangement is characterized by two relatively small diameter cooperating feed rolls that are respectively radially supported by a plurality of light back up rollers that peripherally engage these small feed rolls at locations spaced along the operative lengths of such feed rolls. The spaced rollers thus allow the applied operational stock gripping, feeding and braking forces to be distributed over several support locations along the operative axial length of each feed roll. This new roll arrangement has self aligning and load distributing characteristics by reason of the back up rollers engaging opposed sides of each respectively associated feed roll and bearing the major portion of the operational forces received from the feed rolls at spaced locations along the operative axial lengths of the latter. Next the power drive train or transmission from the output shaft of the electric drive motor to both of the feed rolls incorporate only relatively light low inertia rotating parts such as small diameter gear pulleys and a flexible gear belt; this drive train thus eliminating the high inertia gear sets and large gear pulleys found in the transmissions of conventional electric motor driven roll feeds. The greatly reduced rotational inertia of the present roll arrangement together with the simplified and lightened drive train thus permits the use of a smaller size electric drive motor that will have a lighter and lower inertia armature which in turn further reduces the overall amount of rotational inertia of the roll feeder system.

1 Claim, 3 Drawing Sheets

ROLL FEEDER

The combined improvements resulting from the provision of a lighter roll system, a lighter power train, and a lighter electric drive motor enables a simpler lighter frame structure to be used, all of which makes possible a new and improved roll feeder that has very significant cost and performance advantages over conventional electric motor driven roll feeders.

BACKGROUND OF THE INVENTION

The performance of conventional roll feeders that are driven by synchronous, step or other types of electric motors is to a great extent limited by the excessive amount of rotational inertia in the rotary components of such feeders. Typically here two relatively large heavy high inertia cooperating feed rolls are provided which are rotatably supported at their respective axially outer ends and which are driven by a high energy electric motor through a power transmission that has many relatively heavy high inertia rotating gears, belts, pulleys, etc. Here the total rotational inertia of the heavy roll arrangement, the heavy drive transmission and the required large electric motor not only imposes severe limits on the performance of such conventional roll feeders but also in combination with the necessary accompanying heavy frame structure accounts for the relatively high costs of such conventional roll feeders. Thus although the electronic controls may constitute the major portion of the cost of electric motor driven roll feed systems it is primarily the mechanical aspects of such systems that inhibit substantial increases in the performance and efficiency of these systems.

SUMMARY OF THE INVENTION

This invention provides a new and improved design for an electric motor driven roll feeder wherein each of the principal rotating feeder parts is configured so as to have exceptionally low rotational inertia. This new design includes first an improved roll arrangement wherein a cooperating pair of very light weight small diameter feed rolls are used in conjunction with a plurality of low inertia back up rollers that effectively cradle, trap, mutually align and radially support the small feed rolls at spaced locations along the operative lengths of said feed rolls. These back up rollers comprise ball bearings, the thin rotatable outer rings thereof serving to receive and distribute the operational stock gripping, feeding and braking forces more evenly over the operative axial lengths of the feed rolls rather than having these operational forces applied just to the ends of feed rolls as is done in above noted conventional roll feed systems. This load distributing action by the spaced back up rollers thus enables the use of the noted very small diameter low inertia feed rolls in that these small feed rolls are not here subject to any significant amounts of bending stresses. Secondly, a simplified power drive train or transmission is provided having only a few very light low inertia rotating components for rotatably coupling both of said feed rolls to the output shaft of the electric motor that drives the roll feeder; this power train including essentially a plurality of small coplanar gear pulleys that are interconnected and driven by a flexible belt having teeth on both the inner and outer sides thereof. Thirdly, the electric motor for driving the present feeder can now be made smaller due to the reduced inertia resulting from the above noted modifications in the roll arrangement and the power drive transmission; the resulting smaller motor armature affording a still further reduction in the rotational inertia of the present improved roll feeder.

As a result of making the above noted modifications the feeder frame and the related means for supporting the feed rolls and the power drive transmission can now be lightened considerably which in turn will have a very positive further affect on the cost and weight of the stock feeder.

The feeder frame and roll supports are arranged so as to permit the upper feed roll to be moved in a vertical rectilinear path towards and away from the lower feed roll thereby avoiding any angular change in the desired straight horizontal axis of the stock feed path extending through the feeder as may occur in conventional roll feeders when the movable upper feed roll is displaced through a small circular arc.

DETAILED DESCRIPTION OF THE INVENTION

Figure 5:
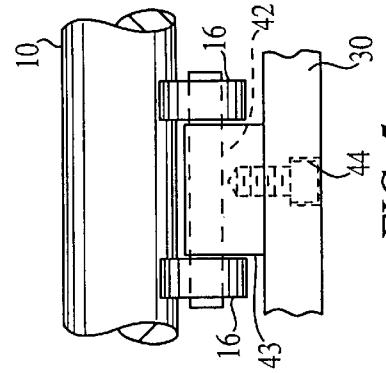
FIG. 5 is a fragmentary front elevational view illustrating the supporting means for the back up rollers.
Figure 2:
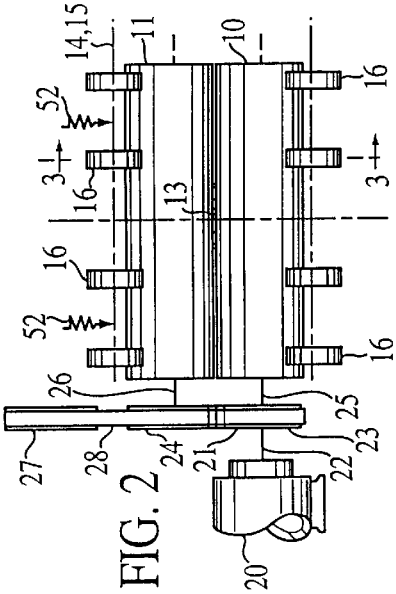
FIG. 2 is a fragmentary schematic front elevational view taken from the right in FIG. 1 and diagrammatically illustrates the mutual orientation of the feed rolls and their associated back up rollers.
Figure 6:
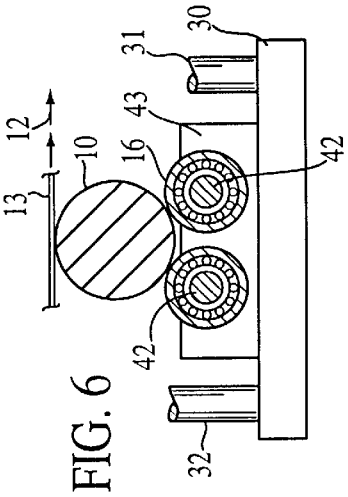
FIG. 6 is a fragmentary side elevational view showing the ball bearing back up rollers for the lower feed roll.
Figure 7:
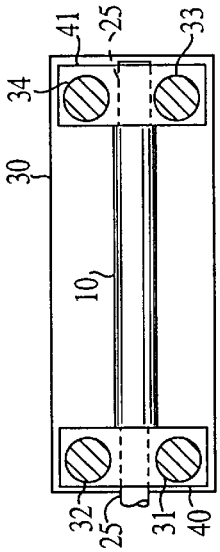
FIG. 7 is a diminuitive partial sectional view taken along section line 7—7 of FIG. 4.
Figure 1:
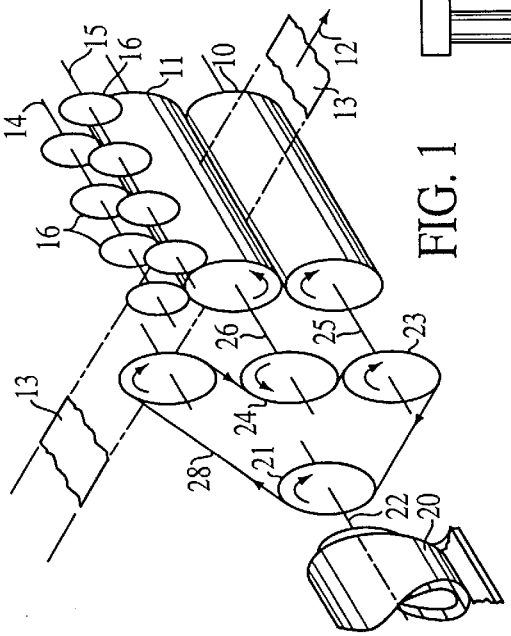
FIG. 1 is a diagrammatic perspective view illustrating the operational nature of the present roll feeder.
Figure 3:
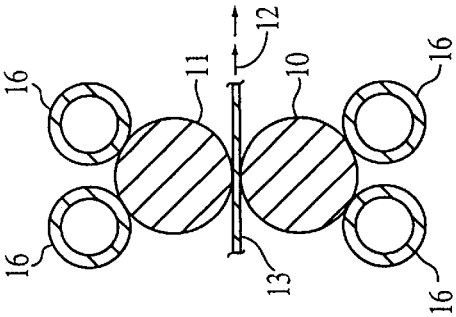
FIG. 3 is a fragmentary side elevational view taken along section line 3—3 of FIG. 2 and also diagrammatically illustrates the mutual orientation of the feed rolls and their associated back up rollers.

The overall function and scheme of operation of the present invention is diagrammatically illustrated in FIG. 1 wherein the two very small diameter cooperating feed rolls 10 and 11 are operative as indicated by arrows 12 to intermittently advance the strip stock 13 to be fed therebetween and into the work station of a punch press or the like. The upper feed roll 11 as shown in FIG. 1 is adapted to be supported at spaced intervals along its operative length by two parallel rows 14 and 15 of small back up rollers 16; the periphery of each roller 16 engaging and thus radially supporting the upper opposed sides of the feed roll 11. This arrangement is illustratively shown for only the upper feed roll 11 in FIG. 1 however a corresponding back up roller arrangement is provided for the lower feed roll 10 as is illustrated in FIGS. 2 and 3. As shown in FIG. 6 the rollers 16 each comprise a ball bearing, however in FIG. 3 they are shown only as thin rings 16 in that the latter are essentially the only major part of the ball bearings that constitute any significant amount of rotational inertia in the back up rollers; the radially inner annulus of each ball bearing being stationarily secured on the end of a fixed shaft as will be described below. FIG. 3 thus represents the minimal total rotational inertia of the light rotating parts comprising the present roll arrangement.

The feed rolls 10 and 11 are adapted to be rotatably driven by a synchronous, stepper or other type of electric motor 20 through a transmission or power train that includes a gear pulley 21, FIG. 1, secured to the output shaft 22 of the motor 20, a pair of gear pulleys 23 and 24 respectively secured to the adjacent reduced ends 25 and 26 of the feed rolls 10 and 11 respectively, an idler gear pulley 27 and a flexible gear belt 28 which has teeth on both the inner and outer sides thereof and which is entrained over the four coplanar pulleys 21,23,24 and 27. As illustrated in FIG. 1 the belt 28 rotatably drives feed rolls 10 and 11 in clockwise and counter-clockwise directions respectively so as to enable said feed rolls to effect the intermittent advancing [12] of the strip stock 13 to be fed.

Figure 4:
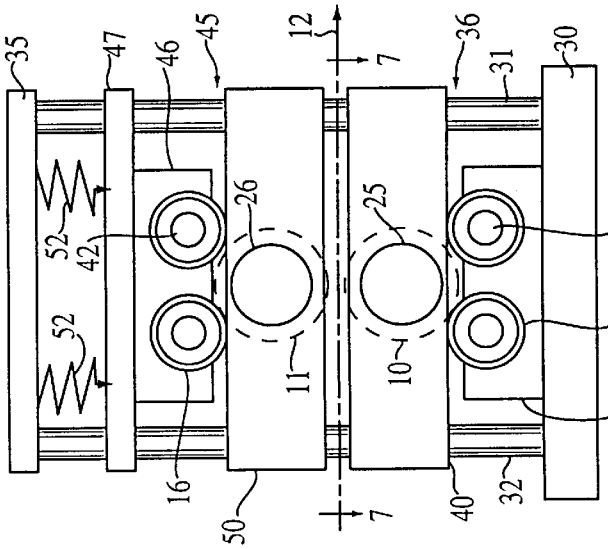
FIG. 4 is a side elevational view schematically illustrating the general structural organization of the main portions of the present roll feeder.

FIGS. 4–7 show in a schematic way the general structural organization of the main portions of the present feeder. Fixedly secured by any suitable means to a frame base plate 30 are the lower ends of four parallel upstanding rigid shafts 31,32,33 and 34 that are fixedly secured at their upper ends to a top frame plate 35. A lower feed roll unit 36 comprises a pair of cooperating side blocks 40 and 41, FIG. 7, which are vertically slidable on shafts 31,32 and 33,34 respectively and which rotatably carry the reduced ends 25 of the lower feed roll 10; the latter being radially supported by the two lower rows of back up rollers 16, FIG. 6. These back up rollers each comprise a ball bearing as illustrated in FIG. 6 and are each respectively mounted on the ends of stub shafts such as 42, FIG. 5, that are fixedly secured to a back up roller block such as 43, FIGS. 5 and 6; the roller block in turn being fixedly mounted on base plate 30 by any suitable fasteners such as screws 44, FIG. 5. As will be apparent the side blocks 40 and 41 will gravitationally lower the feed roll 10 into engagement with the lower two rows of rollers 16 respectively which are positioned on the opposed lower sides of feed roll 10 and which are axially spaced along the operative length of said feed roll 10 so as to cradle and trap the latter as best seen in FIGS. 4 and 6. An upper feed roll unit 45 is constructed and arranged in a corresponding but inverted manner with respect to the said lower roll unit 36, the difference being that the upper back up roller blocks such as 46, FIG. 4, are fixedly secured to an intermediate plate 47 that is vertically slidably mounted on the said four vertical shafts 31–34. An upper pair of opposed cooperating side blocks 50 and 51, FIGS. 4 and 9, that rotatably carry the reduced ends 26 of the upper feed roll 11 are also vertically slidably mounted on said vertical shafts 31–34. Spring means such as that diagrammatically illustrated at 52 in FIG. 4 are operatively disposed between the fixed upper frame plate 35 and the vertically movable plate 47 and serve to yieldably bias the upper feed roll unit 45 as a whole toward the lower feed roll unit 36 and into gripping engagement with the top surface of the stock 13 to be fed between said feed rolls 10 and 11.

Figure 9:
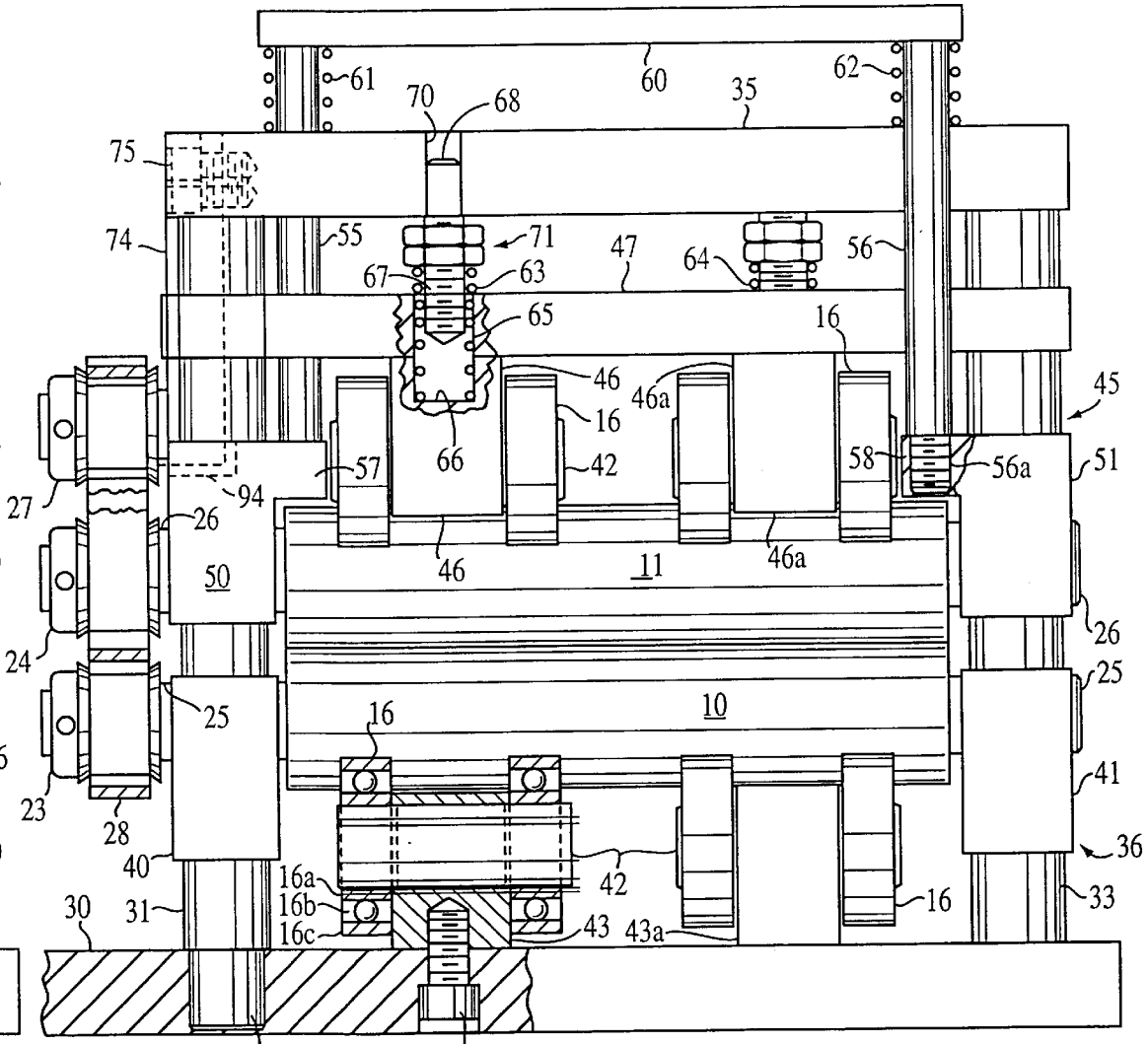
FIG. 9 is a front elevation view taken from the right in FIG. 8.
Figure 10:
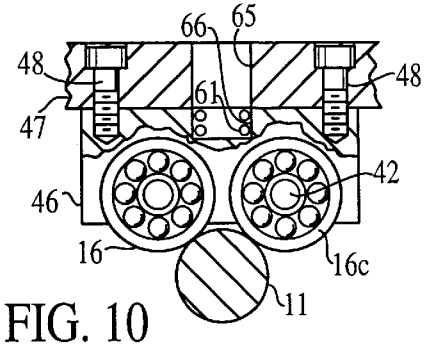
FIG. 10 is a fragmentary side elevational view illustrating the mounting means for the upper back up roller blocks and main spring means.

FIGS. 8–16 show the various structural details of the present roll feeder; many of the reference numerals designating parts here being the same as the similarly numbered corresponding parts mentioned in connection with FIGS. 1–7. Here the frame base plate 30 mounts two side pairs of parallel upstanding shafts 31,32,33 and 34, the reduced lower ends, such as 31*a* of FIG. 9, of which are press fitted or otherwise fixedly secured to the frame base plate 30. The reduced upper ends of said four parallel shafts are fixedly secured to the top frame plate 35 by any suitable means such as set screws 59 of FIG. 8. Mounted on the frame base plate 30 is a lower feed roll unit 36, FIG. 8, comprising a pair of parallel back up roller blocks 43 and 43*a*, FIG. 9, that are secured to the frame base plate by any suitable means such as screws 44. In each of the blocks 43 and 43*a* is fixedly mounted a pair of parallel stub shafts 42 as illustrated in FIGS. 6, 9 and 10. On each extended outer end of each stud shaft is mounted a back up roller 16, FIG. 9, that consists essentially of a conventional type ball bearing that has an inner annular ring 16*a*, FIG. 9, fixed by any suitable means to the end of the associated stub shaft 42, a ball race 16*b* and an outer annular ring 16*c*. The term "ball bearing" as used herein is intended to include a needle bearing or any other similar roller type bearing. As is best seen in FIGS. 6 and 9 the two lower parallel rows of back up rollers 16 form a rotational cradle for the lower feed roll 10 by engaging the respective opposed lower sides , FIGS. 6 and 10, of the latter at axially spaced apart locations along the operative length, FIG. 9, of said feed roll 10. The reduced ends 25 of the small diameter feed roll 10 are rotatably carried by a first cooperating pair of side blocks 40, 41; block 40 being vertically slidably mounted on the left, as seen in FIG. 9, side pair of upstanding shafts 31,32, FIGS. 8 and 9, while block 41 is vertically slidably mounted on the right side pair of shafts 33, 34, FIGS. 7 and 9. As will be apparent the lower pair of side blocks 40,41 will gravitationally lower the feed roll 10 vertically downward and into cradled engagement with the peripheral surfaces of the lower set of back up rollers 16.

An upper roll unit 45 is provided that is constructed and arranged in a manner similar to that for roll unit 36, however here the upper roll unit is inverted and supported by a movable plate 47, FIG. 9, that is vertically slidably mounted on the said four upstanding shafts 31–34. The two parallel upper back up roller blocks 46 and 46*a*, FIGS. 9 and 10, are each secured to the movable plate 47 as by screws 48, FIG. 10 and rotatably carry an upper set of back up rollers 16 in a manner corresponding to that described for the lower roll unit 36, each roller 16 of said upper set comprising a ball bearing similar to that described above for the lower set of back up rollers 16. The upper set of back up rollers similarly define a cradle like support for the upper feed roll 11 that has its reduced ends 26 rotatably carried by the upper cooperating pair of side blocks 50 and 51, FIG. 9. Side block 50 is vertically slidably mounted on shafts 31 and 32 while side block 51 is vertically slidably mounted on shafts 33 and 34, FIGS. 8 and 9. The roll units 36 and 45 are mutually disposed and positioned so that the axes of feed rolls 10 and 11 are retained in vertical coplanar relation by reason of the back up rollers cradling, trapping and mutually aligning said feed rolls which then receive and bear substantially all of the operational gripping, feeding and braking forces that are applied to the feed rolls 10 and 11. As will be apparent the only substantial forces applied to the reduced ends of the feed rolls 10 and 11 are the torque forces received from the output of the electric motor 20.

Elevating means are provided retaining the feed roll 11 in operative engagement with its associated back up rollers 16; such elevating means comprising two vertical rods 55 and 56 that are secured by any suitable means at their lower ends, as by a threaded connection 56*a* illustrated in FIG. 9, to the central and inwardly extending shoulders 57 and 58 respectively formed on the side blocks 50 and 51. Rods 55 and 56 extend upwardly through suitable coaxial circular holes formed in the movable plate 47 and the frame top plate 35. The upper ends of the rods are fixedly connected by any suitable fastening means to a cross bar 60. Relatively light compression coil springs 61 and 62, FIG. 9, are disposed about the upper portions of the rods 55,56 and between the fixed frame top plate 35 and the cross bar 60; these springs being operative to afford sufficient upward forces on the cross bar 60 to lift and at all times maintain the feed roll 11 into and in engagement with its upper set of associated back up rollers 16. A much stronger set of main spring means is provided for yieldably forcing the upper feed roll unit 45 as a whole downwardly towards the lower roll unit 36 so that the feed rolls 10 and 11 can yieldably grip the stock to be fed by and between said cooperating feed rolls. This stronger main spring means comprises two similar laterally spaced apart compression coil springs 63 and 64, FIG. 9, each having similar mountings. Spring 63 is disposed in coaxial holes 65 and 66, FIG. 9, formed in the movable plate 47 and the back up roller block 46 respectively; the axes of holes 65 and 66 being disposed in said vertical plane of the feed rolls 10 and 11. The lower end of spring 63 rests on the bottom of hole 66 while the upper end thereof fits over a depending stud 67, FIG. 9, having a reduced upper end 68 that is fixedly secured to the frame top plate 35 by any suitable means such as by its being press fitted into a hole 70 formed in said plate 35. The lower threaded end of stud 67 has a double lock nut set 71 which may be rotatably adjusted and locked so as to vary the normal downward yieldable force exerted by spring 63 on the left side, as seen in FIG. 9, of the upper roll unit 45. The other main spring 64 is correspondingly arranged so as to be capable of similarly varying the yieldable downward force applied to the right side, FIG. 9, of the roll unit 45. The combined forces applied by the main springs 63,64 are far greater than the forces exerted by the lighter springs 61 and 62 on the feed roll 11 whereby the upper roll unit 45 is continuously biased towards the lower roll unit 36.

Figure 8:
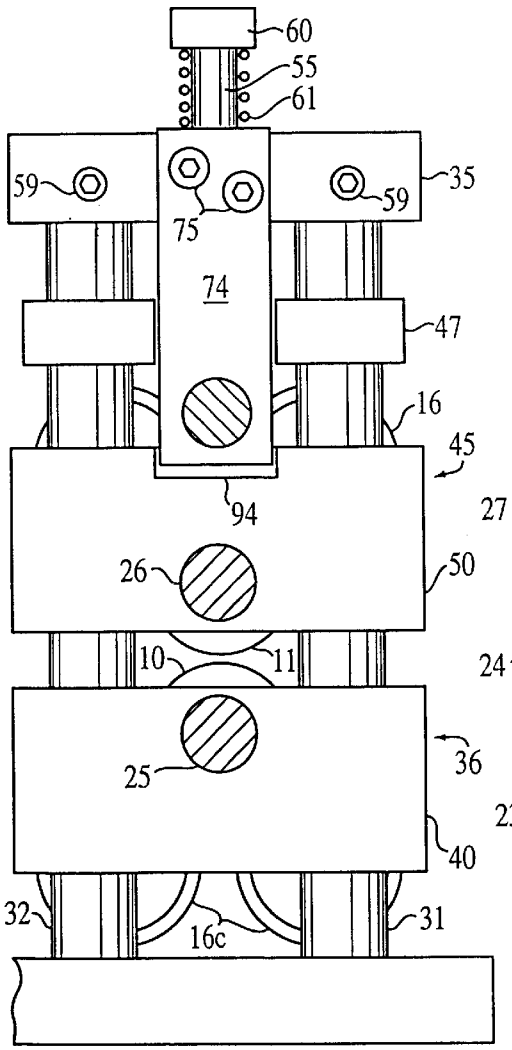
FIG. 8 is a side elevational view showing the structural details of the present roll feeder.
Figure 12:
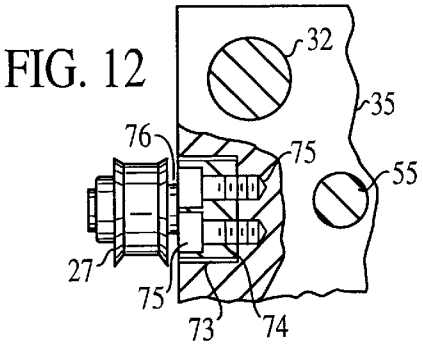
FIG. 12 is a top view of the structure shown in FIG. 11.
Figure 11:
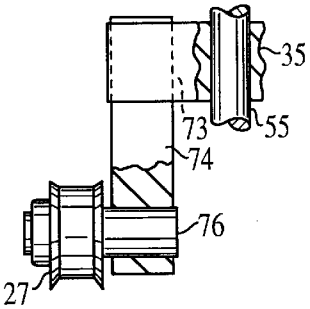
FIG. 11 is a fragmentary front elevational view illustrating the support means for the idler gear pulley.
Figure 16:
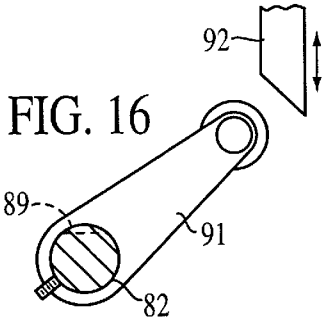
FIG. 16 is a fragmentary side elevational view illustrating a pilot release mechanism for the present roll feeder.
Figure 13:
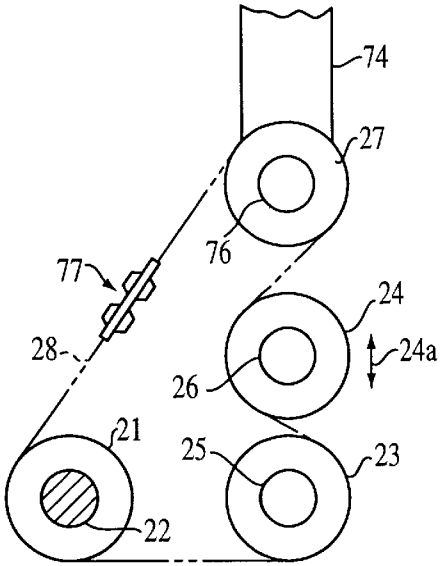
FIG. 13 is a partial side elevational view showing the drive train or power transmission elements for the present feeder.

The power drive train or transmission for the feed rolls will now be described in connection with FIGS. 9,11–13. The left end, as seen in FIGS. 9, 11 and 12, of the top frame plate 35 is formed with a rectangular type U-shaped notch 73, FIG. 12, in which is disposed the upper end of a depending arm 74. This arm is vertically adjustably secured to the plate 35 by screws such as 75, FIGS. 9,12 and 13, that each pass through an associated vertical slot formed in the upper end of arm 74. The lower end of the arm 74 extends into an accommodating slot 94 formed in the upper edge of the side block 40 as is best seen in FIG. 8. Fixedly secured to the lower end of arm 74 is a pivot stud 76 on which is rotatably mounted a small idler gear pulley 27, FIGS. 1 and 11–13. Fixed to the mutually adjacent outer reduced ends 25 and 26 of the feed rolls 10 and 11 are identical gear pulleys 23 and 24 respectively, FIGS. 1,2,9 and 13. The output shaft 22 of the electric motor 20, FIGS. 1 and 2, has fixedly secured thereto a small gear pulley 21. All four of the small light weight gear pulleys 21,23,24 and 27 are disposed in mutual coplanar relation. A flexible Kelvar gear belt 28 having gear teeth formed on both the inner and outer sides thereof, as is illustrated at 77 of FIG. 13, is entrained about the said four pulleys so as to be capable of rotatably driving the feed rolls 10 and 11 as described above in connection with FIG. 1. The vertically adjustable positioning possible for the idler pulley 27 facilitates the installing, tightening and removal of the belt 28 on and from the said four coplanar pulleys.

Figure 15:
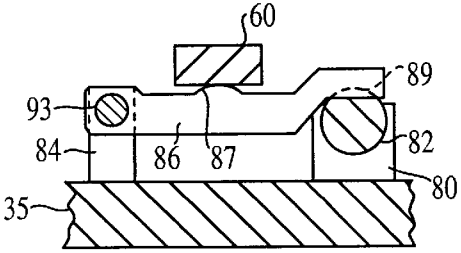
FIG. 15 is a sectional view taken along section line 15—15 of FIG. 14.
Figure 14:
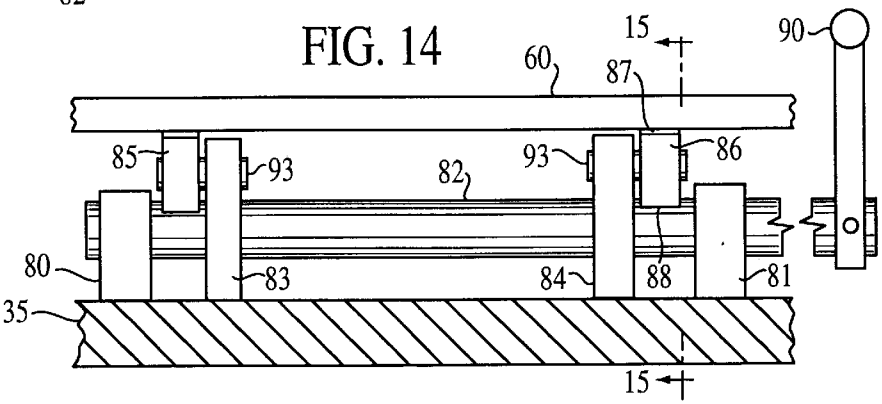
FIG. 14 is a front elevational view illustrating an exemplary upper feed roll release mechanism.

Any suitable means may be used to elevate the upper roll unit 45 for pilot release and stock loading operations of the present roll feeder. For example as shown in FIGS. 14 and 15 two laterally spaced pillow blocks 80 and 81 are fixedly secured by any suitable means to the upper surface of the frame top plate 35 so as to rotatably support a cam shaft 82. Also fixedly mounted on plate 35 are two laterally spaced pivot blocks 83 and 84 on which by means of pivot pins 93 are respectively pivotally mounted the left ends, as seen in FIG. 15, of arms 85 and 86, said arms extending immediately under the cross bar 60 and each having a slight convex upper edge surface portion such as shown at 87 in FIGS. 14 and 15 which engages the lower surface of said bar 60. The lower edges of the right hand ends, as viewed in FIG. 15, of said arms 85 and 86 respectively engage the flat surfaces, such as 88 of FIG. 14, at the bottom of two slots 89, FIGS. 14 and 16, cut in the upper side of said cross shaft 82. A radial handle 90, FIG. 14, fixed to the end of cam shaft 82 enables this shaft to be manually rotated so that the right hand ends of arms 85 and 86 are cammed upwardly which in turn will elevate the cross bar 60 and its two depending rods 55 and 56 thereby slightly raising the upper feed roll unit 45 for initially stock loading the feeder. The cam shaft 82 may also be provided with a roller arm 91, FIG. 16, for pilot release action by a cam 92 secured to an associated press ram. The function and purpose of this type of upper feed roll pilot release action is well understood in the art.

The slight vertcal movements of the upper roll unit 45 occuring during stock loading and pilot release operations are readily accommodated by the present feed roll drive arrangement. As will be best seen in FIG. 13 when the upper feed roll 11 and its attached gear pulley 24 are slightly elevated rectilinearly and vertically against the action of the main springs and away from the lower feed roll 10 with its attached gear pulley 23 and then subsequently moved downwardly by the noted main springs as indicated by arrows 24*a* in FIG. 13, the pulley 24 will simply roll along the now stationary belt 28 while remaining in full no-backlash geared engagement with the belt. This action contrasts with conventional electric motor driven roll feeder systems wherein gear backlash can become a problem when spur or similar gears are used in the drive train for the feed rolls thereof.

A set of two cooperating small feed rolls can, for a given stock squeezing force therebetween, more efficiently grip the stock than can a set of larger feed rolls. Thus in a given stock feeding situation the present roll feeder affords the advantage, in addition to those noted in the SUMMARY OF THE INVENTION above, of being able to apply greater maximum feeding and braking forces to the stock being fed.

What is claimed is:

1. A stock feeder for intermittently advancing strip stock into the work station of a punch press or the like; comprising a frame;

a lower roll unit carried by said frame and including a lower feed roll;

a first mounting means mounted on said frame for upward and downward movement relative to said frame and for rotatably supporting said lower feed roll;

a first set of support rollers arranged in two parallel rows and disposed below said lower feed roll;

a second mounting means carried by said frame for rotatably supporting said first set of support rollers so that said first set of support rollers supports said lower feed roll upon downward movement of said lower feed roll into engagement with said first set of support rollers;

an upper roll unit carried by said frame and including an upper feed roll;

a third mounting means mounted on said frame for upward and downward movement relative to said frame and for rotatably supporting said upper feed roll;

a second set of support rollers arranged in two parallel rows and disposed above said upper feed roll;

a fourth mounting means mounted on said frame for upward and downward movement relative to both said upper feed roll and said third mounting means and for rotatably supporting said second set of support rollers;

biasing means carried by said frame and including spring means operatively disposed between said frame and said fourth mounting means for downwardly biasing said fourth mounting means thereby also downwardly biasing said second set of support rollers, said upper feed roll and said third mounting means so that said upper feed roll is thus yieldably biased downwardly toward said lower feed roll of said lower roll unit;

elevating means connected to said third mounting means for elevating said third mounting means thereby also elevating said upper feed roll, said second set of support rollers and said fourth mounting means so that said upper feed roll may be moved upwardly away from said lower feed roll; and drive means for rotatably driving said lower and upper feed rolls.

* * * * *